US006050449A

United States Patent [19]

Kanj

[11] Patent Number: 6,050,449

[45] Date of Patent: Apr. 18, 2000

[54] POCKET BUSINESS CARD DISPENSER

[76] Inventor: Samir S. Kanj, 12215 S. Blackbob Rd. #206, Olathe, Kans. 66062

[21] Appl. No.: 09/033,751

[22] Filed: Mar. 3, 1998

[51] Int. Cl.[7] ..... B65H 1/08

[52] U.S. Cl. ..... 221/232; 206/39.4

[58] Field of Search ..... 221/232, 268, 221/279, 255; 206/39.4

[56] References Cited

U.S. PATENT DOCUMENTS 3,308,989 3/1967 Alltop et al. ..... 221/232
4,240,564 12/1980 Plitchard ..... 221/232
4,790,435 12/1988 Trusty ..... 206/39
4,792,058 12/1988 Parker ..... 221/232
4,887,739 12/1989 Parker ..... 221/232
5,452,793 9/1995 Dimeo et al. ..... 206/39

*Primary Examiner*—Kenneth W. Noland

[57] ABSTRACT

A pocket-sized business card dispenser which includes a reciprocating ejector mechanism, a drawer for containing a stack of business cards, and a case or housing for containing the ejector, drawer and cards.

2 Claims, 7 Drawing Sheets

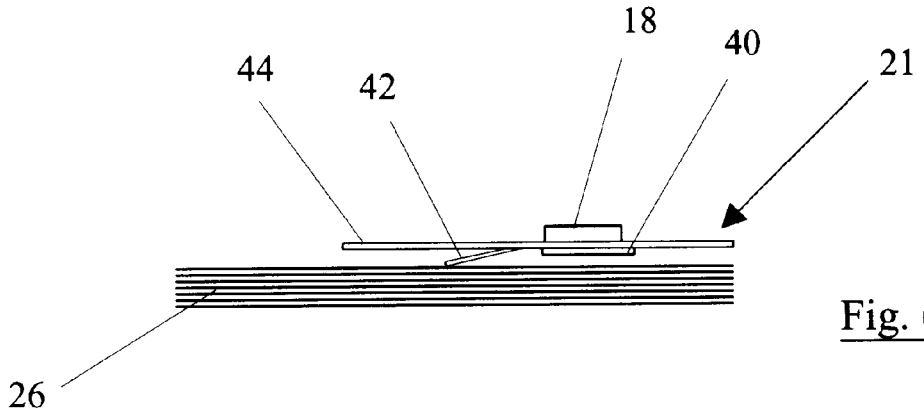
Fig. 6-A
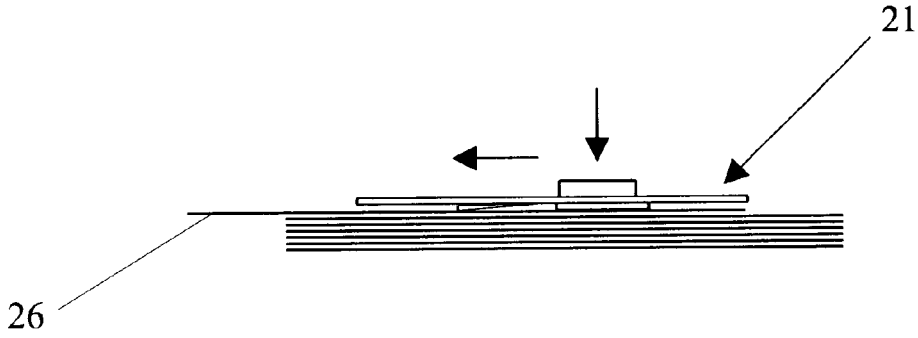
Fig. 6-B

POCKET BUSINESS CARD DISPENSER

BACKGROUND

1. Field of Invention

This invention is generally directed to dispensers for dispensing sheet-like articles from a support casing and more specifically to a compact business card dispenser of a size to be conveniently carried in a person's coat, shirt or pants pocket.

2. Discussion of Prior Art

Business cards are an essential means of communication in today's business and social environments making it necessary for people to carry a plurality of cards to distribute when necessary. Business cards are easily damaged when carried loosely in a wallet, purse or pocket by friction, bending or discoloration. Damaged cards not only portray a person presenting them as unprofessional, but also run the risk of not working with electronic business card scanning equipment. In the past, there have been numerous attempts to provide card carriers and dispensers which serve to house a plurality of cards for dispensing when necessary. Many such prior art dispensers have not proven to be reliable or effective for continuously dispensing a single article at a time from the housing or case in which the cards are stored. The dispenser design in many cases was too complicated to justify manufacturing costs, especially in cases where flanges, grooves, fasteners and complex shaped parts, or simply too many parts were used. In other cases, the size of the dispenser was necessarily enlarged to accommodate an ejector mechanism and/or a card support platform. Many prior art dispensers were hard to refill and/or assemble. In some cases, the cards housed in the dispenser were exposed to the elements making them prone to damage. Also, springs used in prior art dispensers were too complicated, requiring separate fastening devices, or were too hard to assemble into the case. The dispenser was in most cases enlarged in order to make room for operation of springs. Ejector designs have proven to be particularly ineffective, especially in dispensers incorporating a flange or shoulder that engages the rear of the card to eject it. Examples of such related prior art are discussed below:

U.S. Pat. No. 3,308,989 to Alltop et al. (1967) discloses a business card dispenser having a reciprocating card ejector means. The latter is an example of ineffective prior art in business card dispensers. The disadvantages of Alltop's card dispenser design are:

a) Many parts are needed to produce the dispenser, making it impractical for manufacturing.
b) Refilling the dispenser is a confusing process, requiring many steps.
c) The size of the case is enlarged to accommodate an ejector and a spring mechanism.
d) The ejector mechanism is particularly ineffective in dispensing cards because it employs the use of a flange that is supposed to engage the rear of the top most card in a stack and eject it when the ejector is moved forward. This method is very ineffective because of the nature of business card materials. Cards are flexible and easy to tear, as well as compressible. If the ejector button is pressed too hard, more than one card can be engaged at the same time. Also, if pushed too hard, the flange can tear a notch in the rear of the card, causing the ejector mechanism to get stuck and possibly causing the card to get damaged.
e) The dispenser does not accommodate cards of different thickness for single dispensing.

U.S. Pat. No. 4,790,435 to Trusty (1988) discloses a card dispenser whereby the card to be dispensed is exposed via a window opening in the top cover. This dispenser is ineffective for several reasons:

a) To eject a card, one has to use his or her thumb to apply direct pressure upon the card through an opening in the top cover. In dry weather, the coefficient of friction between the user's thumb and the card can be too low thereby not providing enough force to push out a card. Also, if the user's hands are dirty or wet, the card will be smudged giving the user an unprofessional image, or rendering it incompatible with business card scanners widely used in today's businesses.
b) Another problem with this design is that refilling is a complex procedure requiring several steps.

U.S. Pat. No. 5,452,793 to Dimeo et al. (1995) discloses a business card case. The problems with Dimeo's design are that it requires both hands to present a card, making it impractical. Also, the case can be accidentally opened if snagged by loose threads in pockets, or by mishandling, causing the enclosed cards to spill out.

U.S. Pat. No. 4,792,058 to Parker (1988) discloses a Business Card Dispenser. Several disadvantages noted with Parker's design are:

a) An enlarged case is necessary to accommodate the ejector and card support platform.
b) The extensive use of flanges and grooves to guide the card platform and the top cover make it relatively expensive to manufacture this dispenser.
c) The ejector mechanism used is not unlike that discussed in section (d) of U.S. Pat. No. 3,308,989 to Alltop et al. In an improvement to Parker's own design, disclosed in U.S. Pat. No. 4,887,739 to Parker (1989), the ejector mechanism is modified to include rubber bands in close proximity to the flange to help engage the card better. The latter design is not effective because the rubber bands are situated too far to the rear of the card, and also don't have a large enough surface area to engage a card. This makes it easier to bend the card if the front of the card is slightly caught at the slot.
d) A user has no feedback or control over how much frictional force is applied when ejecting a card, since the ejector button is positioned on the side of the dispenser. This is especially a problem when there are too few cards remaining in the stack, and the spring-loaded platform is close to its maximum height.

OBJECTS AND ADVANTAGES

Accordingly, several objects and advantages of my invention are:

a) to provide a business card dispenser capable of dispensing one card at a time;
b) to provide a business card dispenser with an ejector mechanism integrated in such a way that it does not make it necessary to enlarge the dispenser, thereby making it compact in size, and easy to carry;
c) to provide a dispenser that is capable of dispensing cards of various thickness;
d) to provide a dispenser that is capable of protecting the enclosed cards from the elements;
e) to provide a card dispenser that is easy to refill;
f) to provide a card dispenser that is relatively cheap to manufacture.

Still further objects and advantages will become apparent from a consideration of the ensuing description and drawings.

DRAWING FIGURES

Figure 5A:
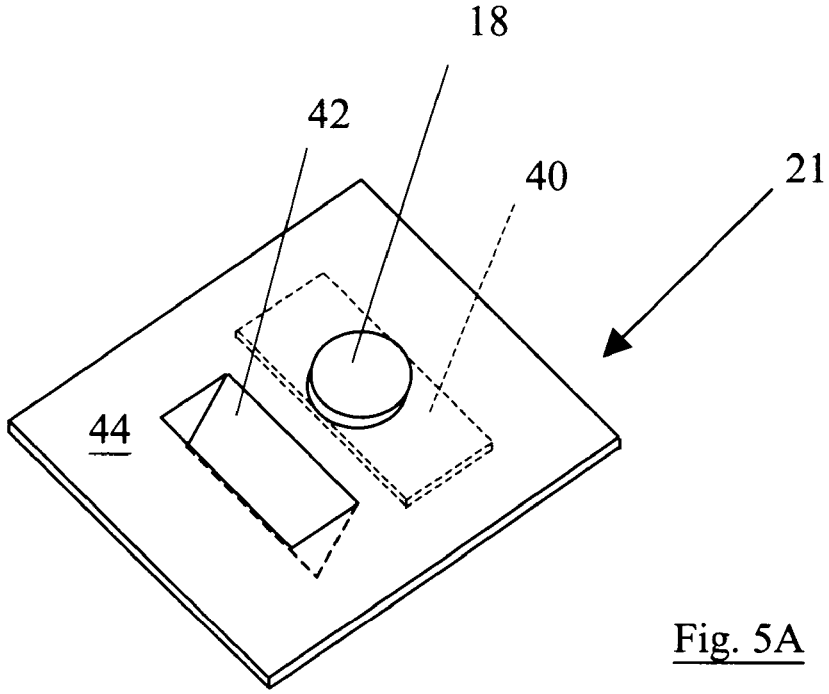
Figure 5B:
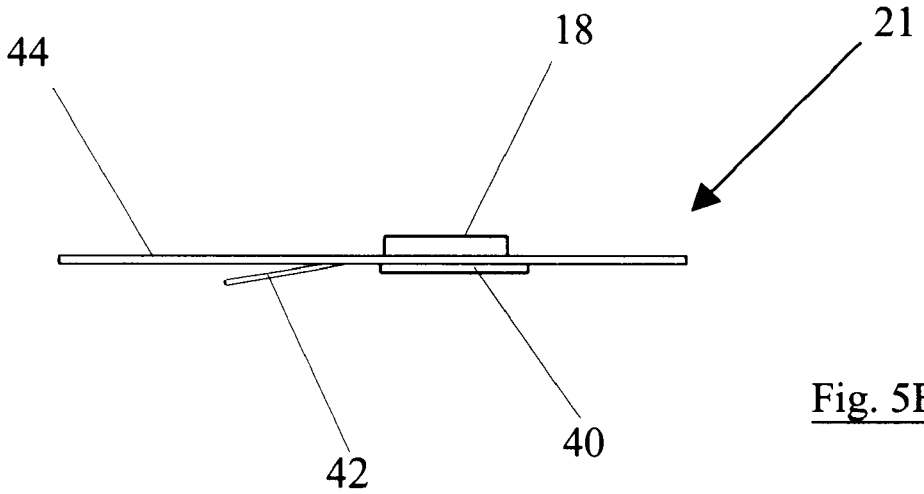

FIG. 5-A is a perspective view of the ejector mechanism.

FIG. 5-A is a perspective view of the ejector mechanism.

FIG. 5-B is an elevation view of the ejector mechanism.

FIG. 6-A is a cross-sectional elevation view of the dispenser showing a stack of business cards in relation to the ejector mechanism in the neutral position (case and drawer not shown).

FIG. 6-B is a cross-sectional elevation view of the dispenser showing a card in the ejected position, with the ejector button depressed (case and drawer not shown).

Figure 7:
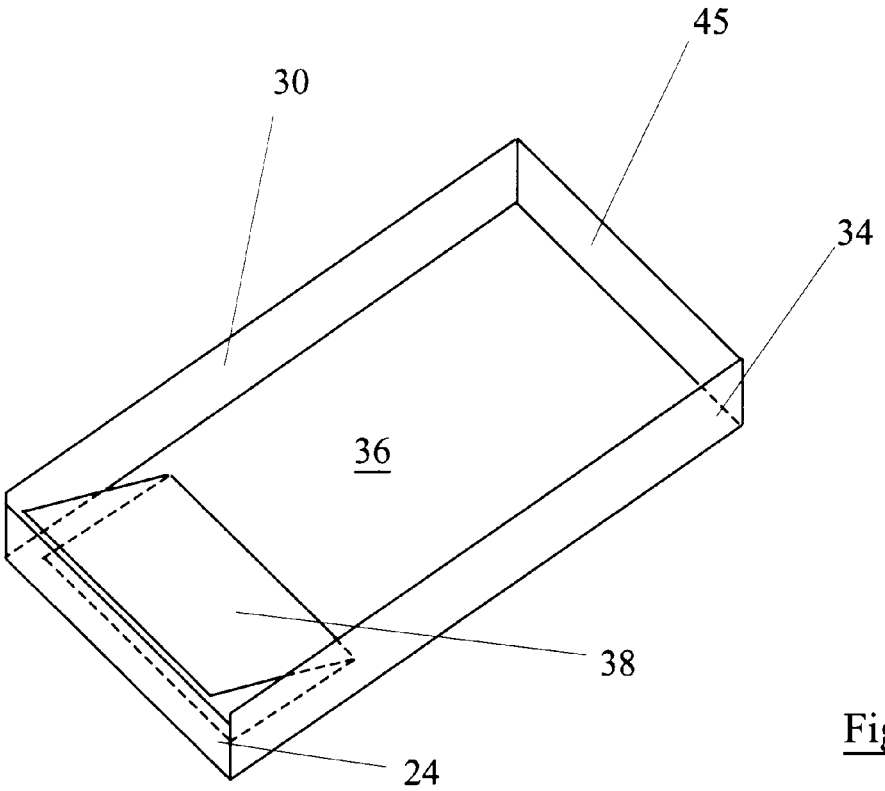

FIG. 7 is a perspective view of an alternative embodiment of the card drawer for dispensing a single thickness card.

Figure 8:
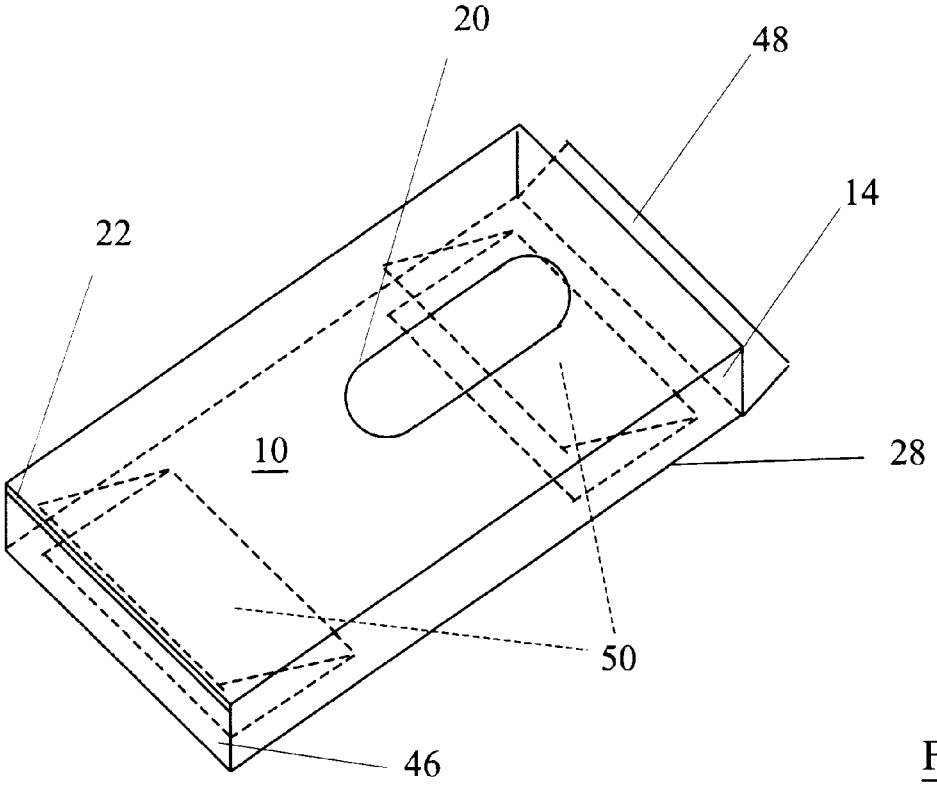

FIG. 8 is a perspective view of an alternate embodiment of the case or housing, designed to eliminate the need for a separate drawer compartment.

LIST OF REFERENCE NUMERALS

| Ref | Name | Ref | Name |
|---|---|---|---|
| 10 | Top wall of case or housing | 11 | Business Card Dispenser assembly |
| 12 | Rear wall of case or housing | 14 | Left side wall of case or housing |
| 16 | Right side wall of case or housing | 18 | Ejector mechanism button |
| 20 | Opening in top wall | 21 | Ejector mechanism |
| 22 | Dispensing slot | 24 | Front wall of card drawer |
| 26 | Business card(s) | 28 | Bottom wall of case or housing |
| 30 | Right side wall of card drawer | 31 | Card drawer |
| 32 | Rear wall of card drawer | 34 | Left side wall of card drawer |
| 36 | Bottom wall of card drawer | 38 | Spring member |
| 40 | Friction member | 41 | Case or housing |
| 42 | Ejector spring member | 44 | Main body of ejector mechanism |
| 45 | Modified Rear Wall of Drawer | 46 | Front wall of modified case |
| 48 | Rear wall of modified case | 50 | Spring members of modified case |

SUMMARY

In accordance with the present invention a business card dispenser comprising of a rigid case, a drawer with springs to resiliently contain a stack of business cards, and an ejector mechanism with friction means to eject a single card through a slot formed when the drawer is inserted into the case.

Description—FIGS. 1, 3, 4, 5-A, 5-B, 6-A, and 6-B

Figure 1:
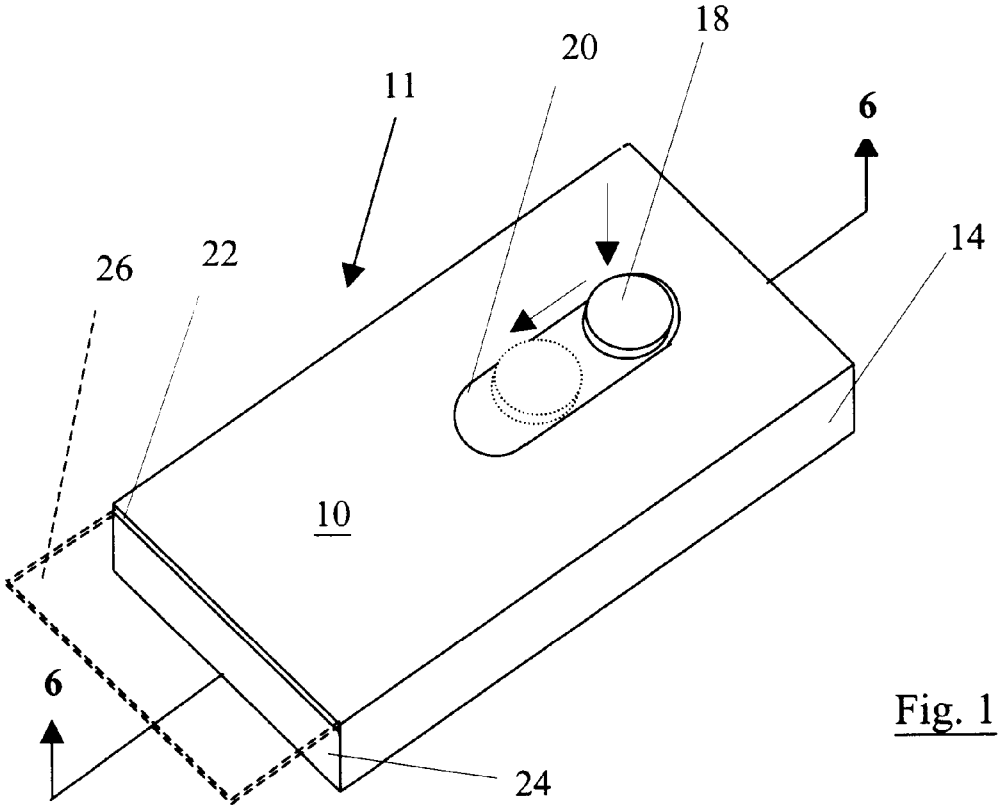
FIG. 1 is a perspective view of the business card dispenser showing, in broken lines, a card in the dispensed position.

A typical embodiment of my business card dispenser is illustrated in FIG. 1. The business card dispenser 11 generally includes a case or housing 41 shown in FIG. 3, a card drawer 31 shown in FIG. 4, and an ejector mechanism 21 shown in FIGS. 5-A and 5-B.

Figure 3:
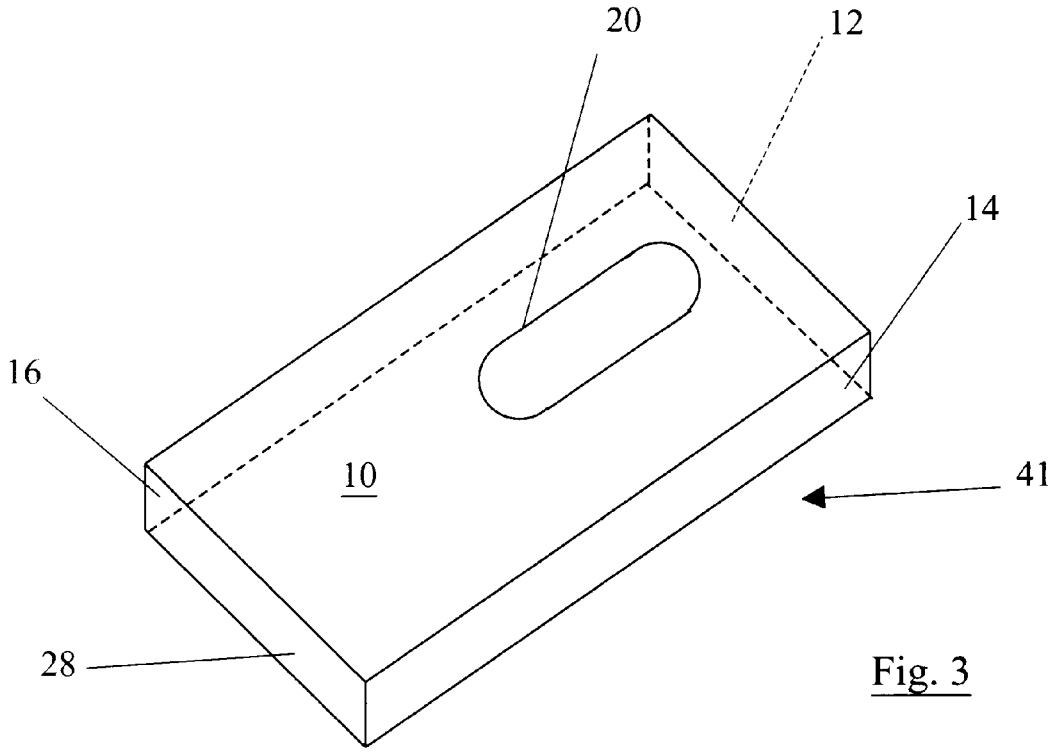
FIG. 3 is a perspective view of the case or housing.

As shown in FIG. 3, the case 41 is rectangular in shape with an open front end. The case is formed by a right side wall16, a left side wall 14, and a rear wall 12, integrally formed with a bottom wall 28, and a top wall 10. An opening 20 in top wall 10 is made to accommodate an ejector button 18 as shown in FIG. 1.

Figure 4:
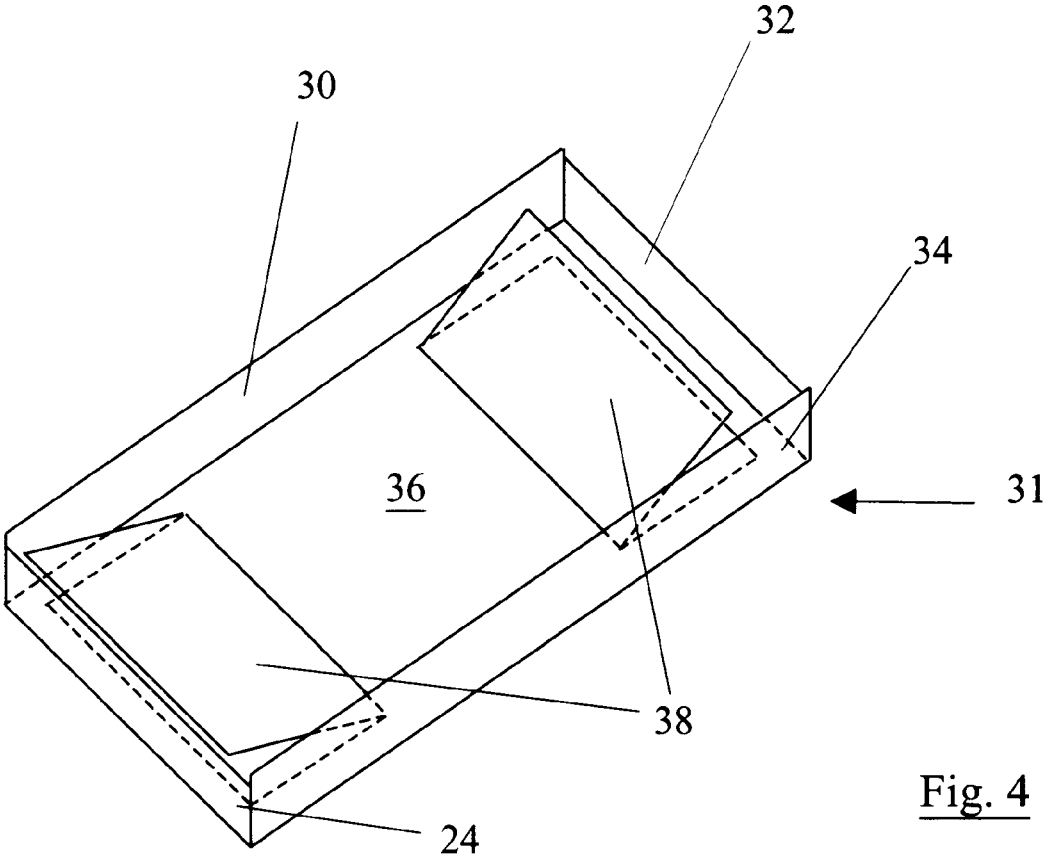
FIG. 4 is a perspective view of the card drawer.

The card drawer 31 is shown in FIG. 4. The drawer is in the shape of a rectangular box, with an open top. A right side wall 30, a left side wall 34, a rear wall 32, and a front wall 24 are integrally formed with a bottom wall 36 to form an open-topped compartment. As shown in FIG. 4, front wall 24 and rear wall 32 are of slightly different heights, while right wall 30 and left wall 34 are of equal height.

The drawer is designed such that when inserted into the case 41, a tight fit is formed with the inside walls of the case 41 such that it would not slide out accidentally due to normal use. When the drawer 31 is inserted into case 41, an opening or slot 22 is formed as shown in FIG. 1. Slot 22 is designed to accommodate only one card at a time. The thickness of slot 22 is equal to the difference in height between the side walls (30 and 34) and whichever wall is facing the front end of case 41. Depending on which of walls 24 or 32 is facing the front end of case 41, the size of slot 22 could be suitable for dispensing either thick or thin business cards. The difference in height between the side walls (30 and 34) and front wall 24 is equal to the average thickness of a thin business card. To dispense thin business cards, drawer 31 is inserted into case 41 with front wall 24 facing the front, open end, of case 41. Similarly, the difference in height between the side walls (30 and 34) and rear wall 32 is equal to the average thickness of a thick business card Therefore, to dispense thick business cards, the drawer is inserted into the case such that rear wall 32 is facing the front end of the case.

As shown in FIG. 4, spring members 38 are formed from bottom wall 36 of the drawer by cutting along the broken lines shown on bottom wall 36, and then pushing the cutout sections upwards through the bottom. A stack of business cards can be vertically arranged in the drawer such that spring members 38 push upwards on the front and rear ends of the stack of cards to be dispensed. The interior dimensions of card drawer 31 are such that it can accommodate a stack of about 10–20 business cards. The exterior dimensions are such that the drawer can be inserted into case 41 with a tight fit.

FIGS. 5-A & 5-B show the ejector mechanism 21. The ejector mechanism is generally rectangular in configuration and extends between the side walls (30 and 34) of drawer 31. The main body 44 of the ejector mechanism is made of a thin flat sheet of plastic or other suitable material. The length of ejector body 44 is generally equal to about half that of a typical business card. The dimensions of ejector body 44 allow the ejector mechanism to be able to move forward and backward in a controlled path when assembled. The ejector body is made to be as thin as could be allowed for the material being used, while still maintaining its sturdiness. An ejector spring member 42 is cut out of ejector body 44 in a similar fashion as spring members 38 of drawer 31. Spring member 42 is formed from ejector body 44 as shown in FIG. 5-A. The top surface of ejector button 18 is shaped to comfortably fit the contours of the thumb (not shown). Ejector button 18 is of sufficient height so as to protrude slightly from slot 22 when the dispenser is fully assembled as shown in FIG. 1. A friction member 40 is attached to the bottom surface of ejector body 44. Friction member 40 has a large surface area, and is very thin to maintain a thin profile for ejector body 44. Friction member 40 is made of a material with a high coefficient of friction with paper, for example rubber. In the neutral position, friction member 40 will not be in contact with the top-most card in the stack, as shown in FIG. 6-A. Friction pad 40 is made to contact the top-most card by pressing down on button 18, causing spring member 42 to flex upward and the top-most card contacting friction member 40, as shown in FIG. 6-B.

From the description above, a number of advantages of my business card dispenser become evident:

(a) The housing or case can be injection molded into a single unit, as can each of the ejector mechanism and the drawer, thereby reducing manufacturing costs, since no finishing or assembly is required after molding.

(b) The dispenser is not necessarily enlarged to accommodate the ejector mechanism and spring members, making it more desirable as a pocket dispenser.

(c) It is possible to manufacture my dispenser from a wide array of available materials, like plastic, metal, and cardboard.

(d) The same dispenser can be used to dispense different thickness business cards without any modifications in the design, making it universal.

(e) The design is esthetically pleasing, and can be made of a wide variety of textures and colors to suit certain market shares.

(f) Loading and reloading is very easy, making it simple to use, and more appealing.

Operation—FIGS. 1, 2, 6A & 6B

Figure 2:
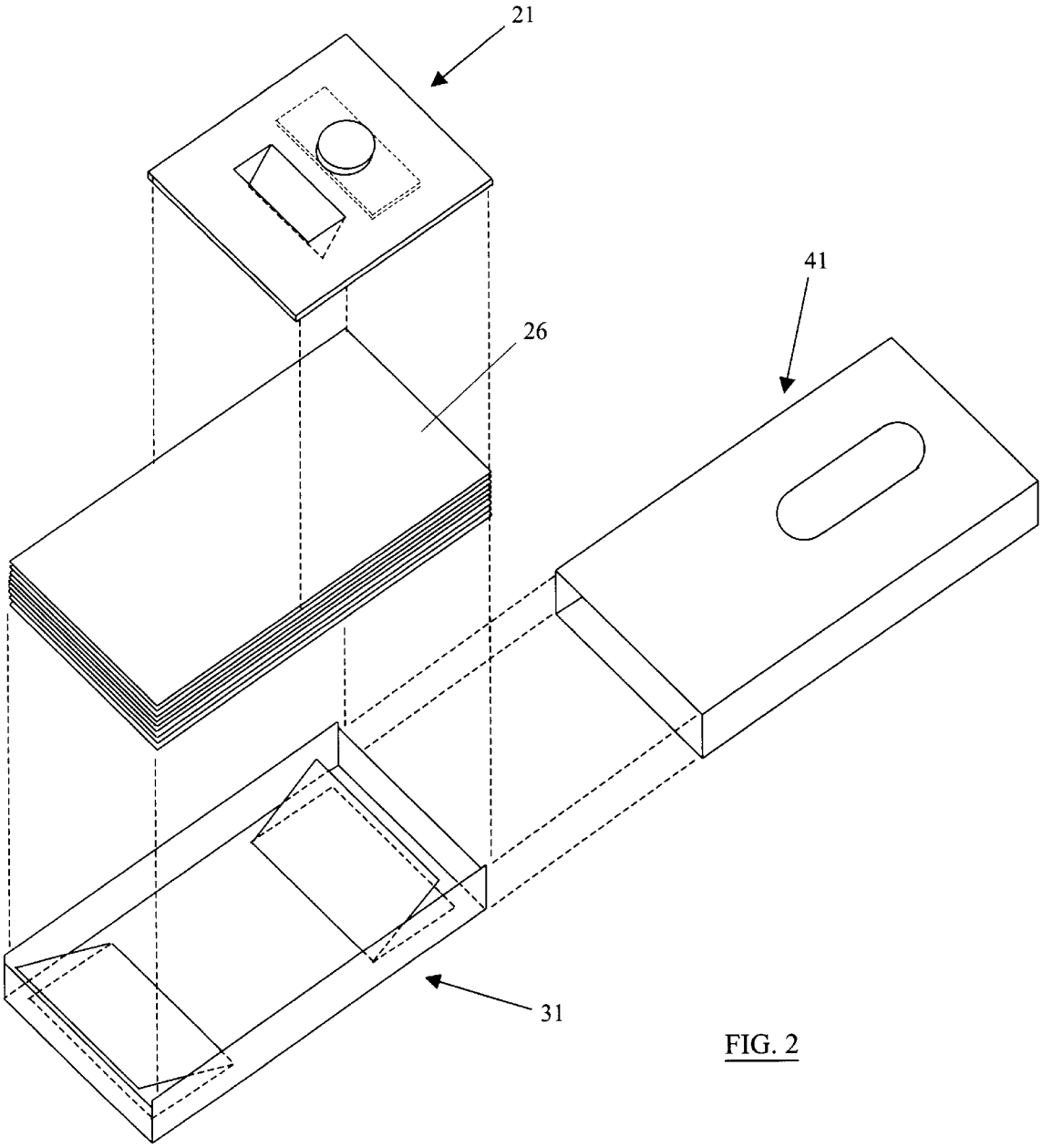
FIG. 2 is an assembly view of the ejector mechanism, card case, drawer, and business cards.

One of the most distinct features of my business card dispenser is its ease of assembly, which in turn makes it easy to reload. Another major feature of my dispenser is its ability to dispense cards of different thickness. Assembly of my card dispenser is shown in FIG. 2. First, a stack of about 10–20 business cards is arranged in the drawer compartment. Next, the ejector mechanism is placed on top of the cards, in effect sandwiching the cards between ejector mechanism 21 and the bottom wall 36 of card drawer 31. With the fore finger and thumb (not shown) compressing the ejector mechanism and cards in the drawer, the assembly is inserted into case 41 until ejector button 18 pops out of slot 20 in top wall 10 of the case. Depending on the thickness of the cards being used, the appropriate end of the drawer, front wall 24 or rear wall 32, is made to face outwards. To dispense a card, the dispenser is held in the palm (not shown), and button 18 is pressed down, then pushed out, causing a single card to be dispensed from slot 22. On pressing ejector button 18, ejector spring member 42 compresses causing friction member 40 to contact the top surface of the top-most card in the stack, as shown in FIG. 6-B. On pushing outwards, the card slides off the stack, and a portion of the card is exposed from slot 22 for withdrawal by the person being presented with the card. On the return stroke, button 18 is pulled back to the starting position without pressing down so that friction member 40 is not in contact with the cards, making it easy to slide the ejector back. The position of springs 38 in the drawer are such that they create an upward force on the cards keeping them aligned in a position parallel to slot 22. When the cards run out, button 18 is pushed all the way down such that friction member 40 contacts bottom wall 36 of the drawer. Upon pushing button 18 forward, the drawer is ejected a short distance out of the housing, enough to pull it out for refilling.

Conclusion, Ramifications, and scope

Accordingly, the reader will see that my business card dispenser succeeds in providing at least the following:

a business card dispenser capable of dispensing one card at a time;

a business card dispenser with an ejector mechanism integrated in such a way that it does not make it necessary to enlarge the dispenser, thereby making it compact in size, and easy to carry;

a dispenser that is capable of dispensing cards of various thickness;

a card dispenser that is capable of protecting the enclosed cards from the elements;

a card dispenser that is easy to refill;

a card dispenser that is relatively cheap to manufacture.

My business card dispenser can be manufactured from a wide array of materials like cardboard and plastic. Recycled materials can be especially beneficial since they help protect our environment.

Manufacturing my dispenser out of recyclable materials is also beneficial in cases when my dispenser will be used as a disposable business card dispenser, which is simply recycled after use instead of refilling. Large companies that specialize in customizing business cards can employ the latter concept by pre-packaging cards in packs of disposable dispensers. When someone orders a large quantity of business cards, he or she can receive them pre-packaged in disposable dispensers for one time usage. Note that the card drawer is designed to accommodate different thickness cards. However, if the dispenser is to be used as a promotional item by a large company to dispense cards of a uniform thickness, the drawer can be modified to accommodate cards of only one thickness. The modified drawer is shown in FIG. 7. As shown in FIG. 7, wall 32 is replaced by wall 45. Wall 45 is the same height as side walls 30 and 34. One of spring members 38 can be eliminated to save on manufacturing costs.

Another embodiment of my business card dispenser could be made by eliminating the drawer compartment altogether, as shown in FIG. 8. In the latter design, the case is modified as follows:

rear wall 12 is replaced by door 48, which is hinged so that it can open and close to allow loading and unloading of cards and the ejector mechanism. Upon closing door 48, it is secured in place by a locking mechanism (not shown).

bottom wall 28 is modified to integrate resilient members 50, similar to spring members 38, to urge a stack of cards upwards. Note that springs 50 are both sloping down towards door 48, thereby facilitating the insertion of cards;

front wall 46 is added to the case. Wall 46 integrates a slot for dispensing cards. The latter slot can be sized accordingly to accommodate a single card.

The latter design is especially suitable for use as a disposable business card dispenser since it eliminates the drawer compartment altogether, thereby reducing the volume of materials used, as well as the cost of manufacturing.

My business card dispenser can also be used to dispense items other than a business card. For example, it can be used to dispense glass slides or tongue depressors for medical purposes. Minor dimensional changes can allow my dispenser to accommodate glass slides or tongue depressors, without departing from the scope of my invention. One advantage in using my design for medical purposes is because the dispenser encloses items to be dispensed in a sterile environment, protecting its contents from the elements.

Yet another embodiment is created by eliminating the ejector mechanism altogether, and enlarging the opening in the top cover of the case to accommodate a user's thumb. To eject a card, the user simply pushes it out with his or her thumb. The latter design is suitable for use in a cleaner environment.

I claim:

1. A dispensing apparatus for sequentially dispensing a plurality of sheet-like articles such as business cards comprising:

a) A case having a rear wall, spaced side walls, a top wall, an elongated opening in said top wall, and a bottom wall, b) a drawer having a front wall, a rear wall, spaced side walls, and a bottom wall, said bottom wall incorporating at least one resilient means for urging a stack of business cards upwards, at least one of said front wall or said rear wall being of a height less than the height of said spaced side walls so as to form a slot through which said business cards are dispensed when the drawer is inserted into the aforementioned case, c) an ejector mechanism made of a flat sheet of suitable material, said flat sheet having both a top and bottom surface, an ejector button positioned on said top surface such that said ejector button can be accessed through the elongated opening in said top wall of aforementioned case upon assembly, a friction means positioned on said bottom surface of said ejector mechanism for urging a card outward, at least one resilient means positioned on said bottom surface of said ejector mechanism such that cards are not in contact with said friction means when the ejector button is not pressed.

2. A dispensing apparatus for sequentially dispensing a plurality of sheet-like articles such as business cards comprising:

a) A case having a front wall, a rear door, spaced side walls, a top wall, an elongated opening in said top wall, a bottom wall, a slot for dispensing items through in said front wall, said rear door being hingeably mounted, said bottom wall incorporating least one resilient member for urging a stack of business cards upwards, b) an ejector mechanism made of a flat sheet of suitable material, said flat sheet having both a top and bottom surface, an ejector button positioned on said top surface such that said ejector button can be accessed through the elongated opening in said top wall of aforementioned case upon assembly, a friction means positioned on said bottom surface of said ejector mechanism for urging a card outward, at least one resilient means positioned on said bottom surface of said ejector mechanism such that cards are not in contact with said friction means when the ejector button is not pressed.

* * * * *